US009452871B1

(12) United States Patent
Ho

(10) Patent No.: US 9,452,871 B1
(45) Date of Patent: Sep. 27, 2016

(54) CONTAINER LID ASSEMBLY

(71) Applicant: Ing Dah Enterprise Co., Ltd., Tainan (TW)

(72) Inventor: Wang-Jyun Ho, Tainan (TW)

(73) Assignee: Ing Dah Enterprise Co., Ltd., Tainan (TW)

( * ) Notice: Subject to any disclaimer, the term of this patent is extended or adjusted under 35 U.S.C. 154(b) by 0 days.

(21) Appl. No.: 14/755,287

(22) Filed: Jun. 30, 2015

(51) Int. Cl.

| | |
|---|---|
| ***B65D 53/02*** | (2006.01) |
| ***B65D 43/02*** | (2006.01) |
| ***B65D 45/02*** | (2006.01) |
| ***B65D 25/28*** | (2006.01) |

(52) U.S. Cl.
CPC ..... *B65D 53/02* (2013.01); *B65D 25/28* (2013.01); *B65D 43/02* (2013.01); *B65D 45/02* (2013.01); *B65D 2525/283* (2013.01); *B65D 2543/00231* (2013.01); *B65D 2543/00972* (2013.01)

(58) Field of Classification Search
CPC .. B65D 53/02; B65D 25/2882; B65D 25/28; B65D 39/16; B65D 51/18; B65D 43/0229; B65D 43/0225; B65D 43/0202; B65D 43/02; B65D 43/021; B65D 43/0214; A47J 27/08; A47J 36/06
USPC ..... 220/255, 254.8, 254.1, 259.3, 256.1, 220/259.5, 212.5, 212, 789, 780, 804, 801, 220/796, 304, 288, 573.1; 215/228, 320, 215/318, 317, 316, 358, 356, 355
See application file for complete search history.

(56) References Cited

U.S. PATENT DOCUMENTS

| | | | | | |
|---|---|---|---|---|---|
| 1,006,792 | A * | 10/1911 | Reubold | B60K 15/0406 | 220/200 |
| 2,102,673 | A * | 12/1937 | Brown | B65D 53/02 | 277/637 |
| 2,198,125 | A * | 4/1940 | Nelson | A47J 27/092 | 220/203.05 |
| 2012/0305519 | A1 * | 12/2012 | Lee | B65D 47/2006 | 215/316 |

* cited by examiner

*Primary Examiner* — Robert J Hicks
(74) *Attorney, Agent, or Firm* — Alan D. Kamrath; Kamrath IP Lawfirm, P.A.

(57) ABSTRACT

A container lid assembly is a lid unit for covering an upper-end opening of a container. The lid unit includes a lower connecting member peripherally mounted with a ring, an intermediate covering member, and an upper connecting member stacked in order. When the lid unit covers the container's opening and the upper connecting member is rotated manually, the lower connecting member is driven to move upward so that the ring at the periphery is pushed outward by the lower end of the intermediate covering member and closes the container's opening even more tightly, thereby providing desired sealing for the container.

6 Claims, 5 Drawing Sheets

CONTAINER LID ASSEMBLY

BACKGROUND OF THE INVENTION

1. Technical Field

The present invention relates to container lids and, more particularly, to a container lid assembly that is designed as a lid unit for closing an opening at an upper end of a container and comprises a lower connecting member with a ring mounted around an outer periphery thereof, an intermediate covering member, and an upper connecting member stacked in order, so that when the lid unit covers the container's opening and the upper connecting member is manually rotated, the lower connecting member is driven to move upward and push the peripheral ring outward by the lower end of the intermediate covering member, to close the container's opening even more tightly, thereby providing desired sealing for the container.

2. Description of Related Art

For preventing moisture and insects such as ants from entering containers that contain foods, sealing lids are provided at openings of containers to close the containers tightly for keep the containers closed as desired.

While the existing sealing lids for containers somehow provide the desired closeness in practice, the sealing effect thereof can be improved. The present invention herein provides a new design for lids that cover containers with a better sealing effect that is easy to operate and is effective in preventing external air and insects from entering the containers.

BRIEF SUMMARY OF THE INVENTION

The present invention provides a new form of lids that cover an upper-end opening of a container that contains eatable or uneatable objects. The lid unit comprises a lower connecting member with a ring mounted around an outer periphery thereof, an intermediate covering member, and an upper connecting member stacked in order. When the lid unit covers the container's opening and the upper connecting member is manually rotated, the lower connecting member is driven to move upward and push the peripheral ring outward by the lower end of the intermediate covering member, to close the container's opening even more tightly, thereby providing desired sealing for the container.

The primary objective of the present invention is to provide a lid unit for closing an opening at an upper end of a container that is configured to contain eatable or uneatable objects. The lid unit comprises: a lower connecting member with a ring mounted around an outer periphery thereof, an intermediate covering member, and an upper connecting member, a lower connecting member with a ring mounted around an outer periphery thereof, an intermediate covering member, and an upper connecting member. For covering the assembled lid unit over the opening of the container, the intermediate covering member has a bottom periphery thereof abutting against the opening, and lower connecting member that has directional interference with the upper connecting member is placed in the opening. When the upper connecting member is manually rotated, the downward-facing upper guiding portion draws close or pushes away the corresponding lower guiding portion of the lower connecting member, and the downward-facing introverted pushing section of the intermediate covering member pushes the ring at an approaching end of the lower connecting member outward, to close the opening of the container tightly.

A second objective of the present invention is to provide the lid unit, with the upper and lower guiding portions formed correspondingly at the upper and lower connecting members of the lid unit with an externally threaded section and an internally threaded section.

A third objective of the present invention is to provide the lid unit, with the upper and lower guiding portions formed correspondingly at the upper and lower connecting members of the lid unit with an abutting protrudent portion and a spiral groove having a predetermined depth.

A fourth objective of the present invention is to provide the lid unit, with at least one or more than one retaining ridge provided on each of a lower part of the intermediate covering member of the lid unit and the opening of the container correspondingly to prevent the intermediate covering member from rotating with the upper connecting member when the upper connecting member is rotated.

A fifth objective of the present invention is to provide the lid unit, with a raised segment at an upper part of the upper connecting member of the lid unit, for a human hand to hold and thereby rotate the upper connecting member.

A sixth objective of the present invention is to provide the lid unit, with the upper and lower guiding portions correspondingly formed on the upper and lower connecting members of the lid unit each having an interfering end near their connecting parts, to prevent the upper and lower guiding portions from departing from each other when rotation is performed to an extreme.

BRIEF DESCRIPTION OF THE SEVERAL VIEWS OF THE DRAWINGS

The structure as well as a preferred mode of use, further objectives, and advantages of the present invention will be best understood by referring to the following detailed description of some illustrative embodiments in conjunction with the accompanying drawings, in which.

DETAILED DESCRIPTION OF THE INVENTION

Figure 1:
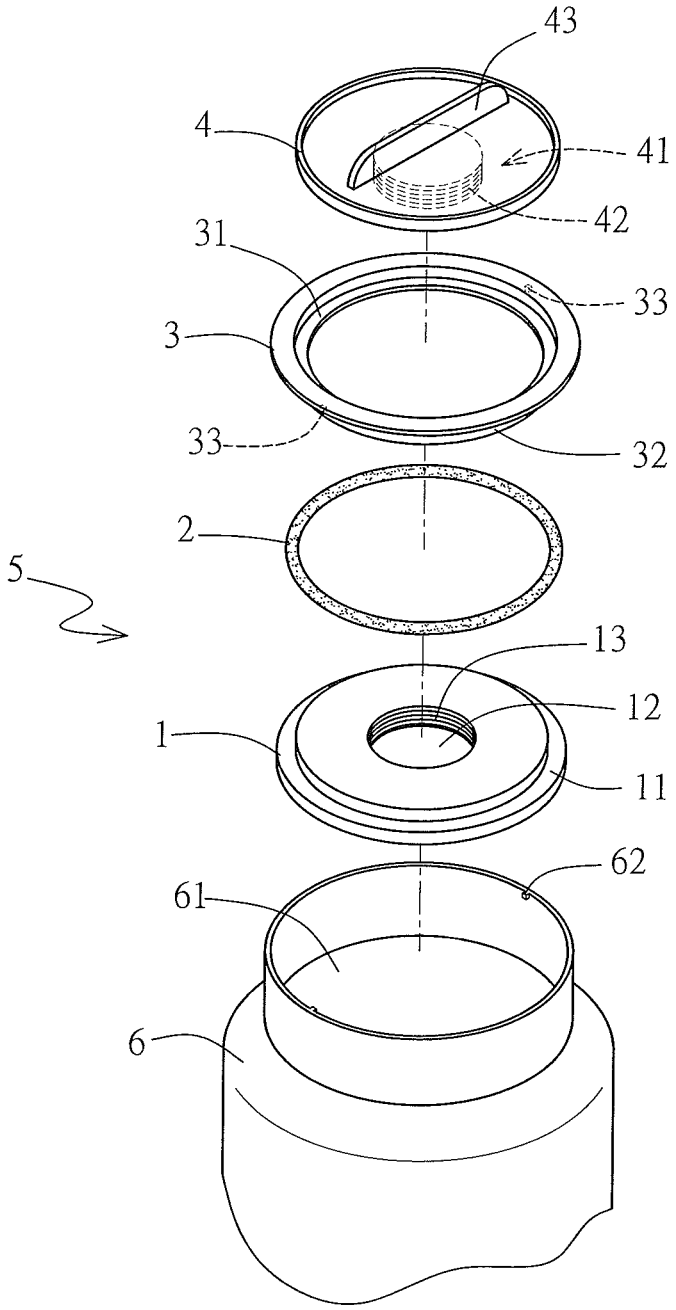
FIG. 1 is an exploded view of a container lid of the present invention.
Figure 2:
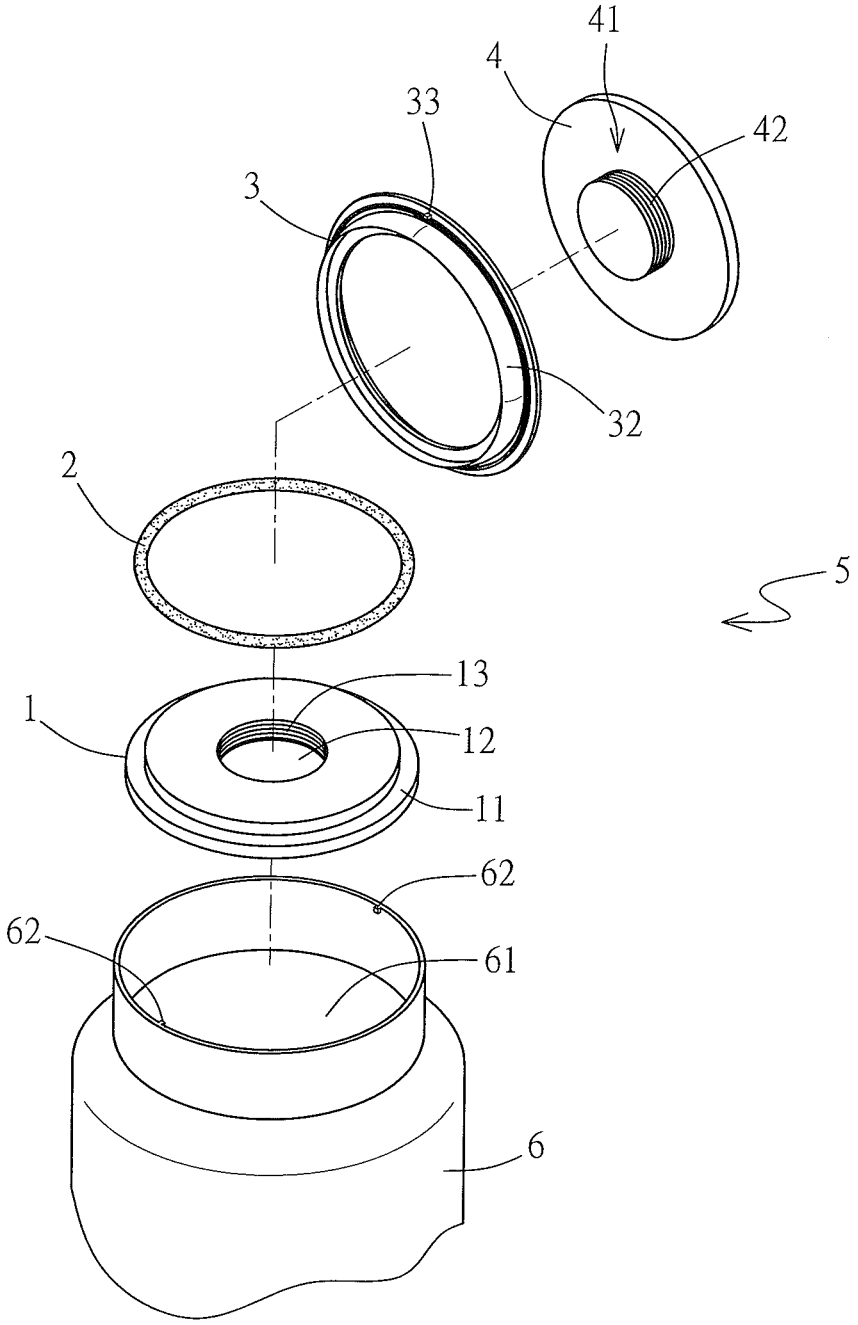
FIG. 2 is another exploded view of the container lid of the present invention.

The present invention provides a container lid assembly (as shown in FIG. 1 and FIG. 2) designed as a lid unit 5 for closing an upper-end opening 61 at an upper end of a container 6 that is configured to contain eatable or uneatable objects. The lid unit 5 comprises: a lower connecting member 1 with a ring 2 mounted around its outer periphery, an intermediate covering member 3, and an upper connecting member 4.

Figure 4:
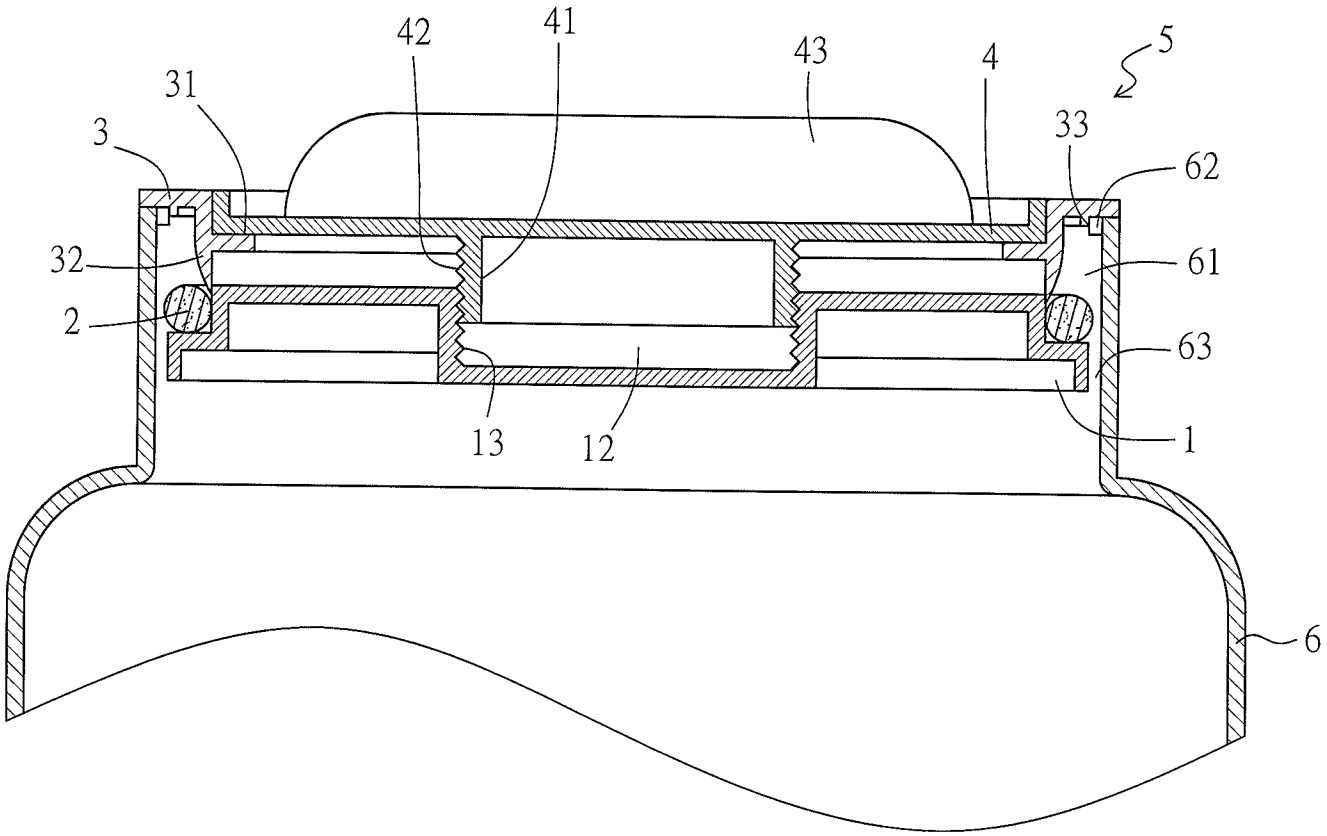
FIG. 4 is a cross-sectional view of the container lid of the present invention, with the container lid covering the container but not turned to close the container.

The lower connecting member 1 is a slightly narrow outer-periphery covering component determined according to the upper-end opening 61 of the container 6. At the outer periphery of the lower connecting member 1, there is an annularly recessed step 11 for receiving the ring 2 (as shown in FIG. 4). The lower connecting member 1 further has a step 12 depressed from its surface at a predetermined site. In the present embodiment, the step 12 depicted is depressed from the center. The step 12 has its outer periphery formed with a lower guiding portion 13. In the present embodiment, the lower guiding portion 13 is an internally threaded section.

The intermediate covering member 3 is a covering component configured to match the periphery of the upper-end opening 61 of the container 6. The intermediate covering member 3 has its upper end formed with a depressed step 31. At a predetermined downward-facing site on the intermediate covering member 3, there is an introverted pushing section 32 extending outward (as shown in FIG. 2). The intermediate covering member 3 is hollow. Along the lower part of the intermediate covering member 3 and in a predetermined range, there is at least one or more than one retaining ridge 33.

The upper connecting member 4 is a rotatable component determined according to the intermediate covering member 3. At a predetermined site at the bottom of the upper connecting member 4, there is a downward-extending connecting section 41. An upper guiding portion 42 is formed at the outer periphery of the connecting section 41. In the present embodiment, the upper guiding portion 42 is an externally threaded section. At the upper part of the upper connecting member 4, there is a raised segment 43 (as shown in FIG. 1) for a human hand to hold and thereby rotate the upper connecting member 4.

Moreover, at least one or more than one retaining ridge 62 is formed in a predetermined range of the upper-end opening 61 of the container 6. The retaining ridge 62 is configured to directionally abut against the retaining ridge 33 at the lower part of the intermediate covering member 3, so that when the upper connecting member 4 is rotated, the intermediate covering member 3 is prevented from rotating with it.

To assemble the lower connecting member 1 having the ring 2, the intermediate covering member 3, and the upper connecting member 4 together (as shown in FIG. 1, FIG. 2 and FIG. 4), the first step is to set the upper connecting member 4 against the depressed step 31 at the upper end of the intermediate covering member 3, to make the downward-extending connecting section 41 of the upper connecting member 4 enter the hollow portion of the intermediate covering member 3. As a second step, the upper guiding portions 42 formed at the outer periphery of the connecting section 41 of the upper connecting member 4 is screwed into the lower guiding portion 13 of the corresponding step 12 of the lower connecting member 1. Thus, so-that when the upper connecting member 4 is rotated, the lower connecting member 1 is driven to approach or leave. The third step relates to covering the upper-end opening 61 of the container 6 with the assembled lid unit 5. Therein, the retaining ridge 33 at the lower part of the intermediate covering member 3 abuts against the retaining ridge 62 of the upper-end opening 61 of the container &opening, to prevent the intermediate covering member 3 from rotating with the upper connecting member 4 that is rotated.

Figure 3:
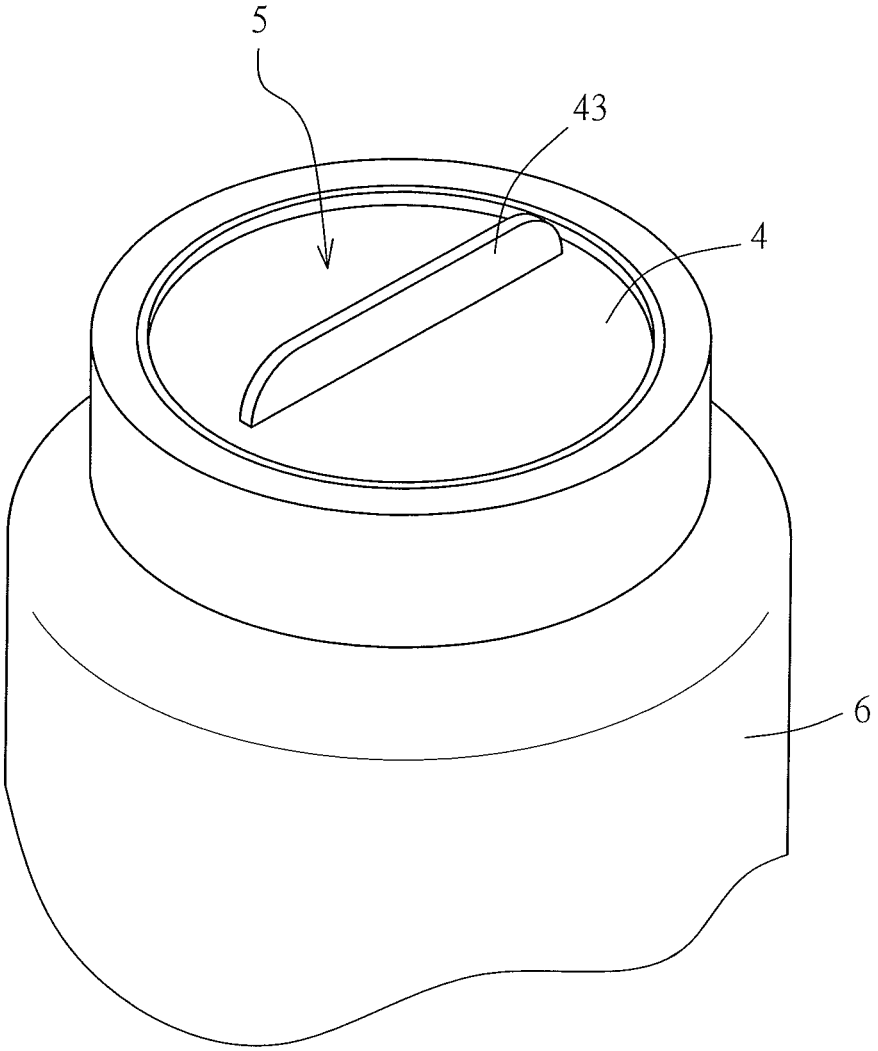
FIG. 3 is a perspective view of the container lid of the present invention.
Figure 5:
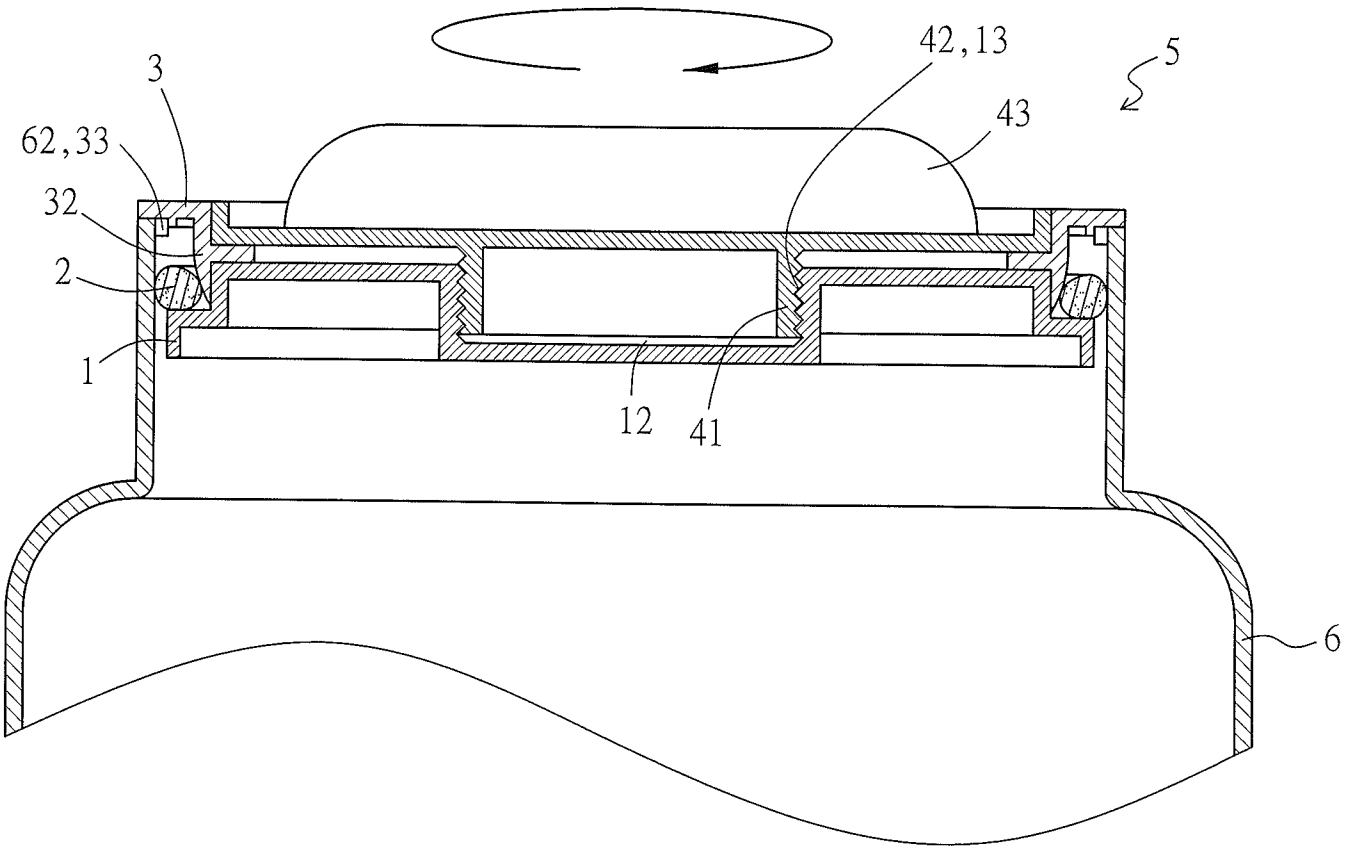
FIG. 5 is another cross-sectional view of the container lid of the present invention with the container lid covering the container and turned to close the container.

To seal the upper-end opening 61 of the container 6 that is covered by the lid unit 5 (as shown in FIG. 3), the intermediate covering member 3 of the lid unit 5 has its bottom periphery abutting against the upper-end opening 61 (as shown in FIG. 5), and the lower connecting member 1 that has directional interference with the upper connecting member 4 is placed into the upper-end opening 61. Thus, when a user holds the raised segment 43 to rotate the upper connecting member 4 (in the direction indicated by the arrow in FIG. 5), the downward-facing upper guiding portion 42 can drive the lower guiding portion 13 of the corresponding step 12 of the lower connecting member 1 to move upward to approach or move downward to leave. In the present embodiment, the operation makes the lower guiding portion 13 move upward. As a result, the downward-facing introverted pushing section 32 of the intermediate covering member 3 pushes the ring 2 at the approaching end of the lower connecting member 1 outward to contact with the wall of the upper-end opening 61 of the container 6 more closely. When the upper connecting member 4 is rotated in an opposite direction, the downward-facing upper guiding portion 42 pushes the lower guiding portion 13 of the corresponding step 12 of the lower connecting member 1 downward, to leave a gap 63 between the lower connecting member 1 and the wall of the opening 61 of the container 6 (as shown in FIG. 4), thereby allowing the lid unit 5 to be removed from the upper-end opening 61 of the container 6.

As to the upper and lower guiding portions 42, 13 formed correspondingly on the upper and lower connecting members 4, 1 of the lid unit 5, they may be the externally and internally threaded sections as depicted. Alternatively, they can be an abutting protrudent portion and a spiral groove having a predetermined depth formed correspondingly on the upper and lower connecting members 4, 1 (not shown). In addition, the upper and lower guiding portions 42, 13 correspondingly formed on the upper and lower connecting members 4, 1 each have an interfering end near the connecting parts, to prevent the upper and lower guiding portions 42, 13 from departing from each other when the rotation is performed to an extreme (not shown).

What is claimed is:

1. A container lid assembly designed as a lid unit for closing an opening at an upper end of a container that is configured to contain eatable or uneatable objects, with the container lid assembly comprising a lower connecting member with a ring mounted around an outer periphery thereof, an intermediate covering member, and an upper connecting member;

with the lower connecting member having a depressed step at a predetermined site, and a lower guiding portion formed at an outer periphery of the depressed step, with the upper connecting member having an outer periphery configured to abut against a step depressed from an upper end of the intermediate covering member, with the intermediate covering member having an introverted pushing section extending outward from a predetermined downward facing site, with the upper connecting member having a connecting section extending downward from a predetermined site at a bottom thereof, with an upper guiding portion formed at an outer periphery of the connecting section, wherein the upper guiding portion works with the lower guiding portion of the corresponding step of the lower connecting member, wherein for covering the assembled lid unit over the opening of the container, the intermediate covering member has a bottom periphery thereof abutting against the opening, wherein the lower connecting member that has directional interference with the upper connecting member is placed in the opening, wherein when the upper connecting member is manually rotated, the upper guiding portion draws close or pushes away the corresponding lower guiding portion of the lower connecting member, and the introverted pushing section of the intermediate covering member pushes the ring at an approaching end of the lower connecting member outward, to close the opening of the container tightly.

2. The container lid assembly of claim 1, wherein the upper and lower guiding portions formed correspondingly at the upper and lower connecting members of the lid unit are an externally threaded section and an internally threaded section.

3. The container lid assembly of claim 1, wherein the upper and lower guiding portions formed correspondingly at the upper and lower connecting members of the lid unit are an abutting protrudent portion and a spiral groove having a predetermined depth.

4. The container lid assembly of claim 1, wherein at least one or more than one retaining ridge is provided on each of a lower part of the intermediate covering member of the lid unit and the opening of the container correspondingly to prevent the intermediate covering member from rotating with the upper connecting member when the upper connecting member is rotated.

5. The container lid assembly of claim 1, further comprising a raised segment at an upper part of the upper connecting member of the lid unit for a human hand to hold and thereby rotate the upper connecting member.

6. The container lid assembly of claim 1, wherein the upper and lower guiding portions correspondingly formed on the upper and lower connecting members of the lid unit each have an interfering end, to prevent the upper and lower guiding portions from departing from each other when rotation is performed to an extreme.

* * * * *